US007007520B1

(12) United States Patent
Lin

(10) Patent No.: US 7,007,520 B1
(45) Date of Patent: Mar. 7, 2006

(54) COMBINATION LOCK

(76) Inventor: Yu-Feng Lin, No. 3, Lane 88, Sec. 1, Jhongsing Rd., Wugu Township, Taipei County (TW)

( * ) Notice: Subject to any disclaimer, the term of this patent is extended or adjusted under 35 U.S.C. 154(b) by 0 days.

(21) Appl. No.: 11/080,609

(22) Filed: Mar. 14, 2005

(51) Int. Cl.
*E05B 37/02* (2006.01)

(52) U.S. Cl. ..... 70/21; 70/28; 70/44; 70/284; 70/285

(58) Field of Classification Search ..... 70/21, 70/27–29, 41–47, 284, 285, DIG. 63, DIG. 71
See application file for complete search history.

(56) References Cited

U.S. PATENT DOCUMENTS 4,860,561 A * 8/1989 Hwang ..... 70/28
6,082,155 A * 7/2000 Su ..... 70/22
6,363,757 B1 * 4/2002 Yu ..... 70/28
6,381,997 B1 * 5/2002 Chen ..... 70/28
6,792,778 B1 * 9/2004 Chen ..... 70/21
6,843,080 B1 * 1/2005 Yu ..... 70/21
6,928,842 B1 * 8/2005 Huang ..... 70/21
2005/0039500 A1 * 2/2005 Yu ..... 70/25

* cited by examiner

*Primary Examiner*—Lloyd A. Gall
(74) *Attorney, Agent, or Firm*—Pro-Techtor Int'l Services

(57) ABSTRACT

Provided is a combination lock capable of being opened by inserting a key into keyhole in addition to turning tumbler wheels to a set series of numbers. In the key opening operation key is turned to rotate shaft, cam, and shuttle assembly for aligning tabs with the grooves, causing the cam to contact and push an L-shaped member laterally to compress a spring-loaded member for opening a gap between the leg and the shackle with a distance between the shaft and a blind end of a channel of the shuttle assembly being decreased to a minimum as the channel slides relative to the shaft, and moving the tabs along the grooves to project the shuttle assembly from one end of a bore of a spring-loaded moveable member to the other end thereof.

2 Claims, 8 Drawing Sheets

COMBINATION LOCK

BACKGROUND OF THE INVENTION

1. Field of Invention

The present invention relates to combination locks and more particularly to a combination lock capable of being opened by inserting a key into keyhole in addition to turning tumbler wheels to a set series of numbers.

2. Related Art

Combination locks are well known. A type of combination lock capable of being opened by inserting a key into keyhole in addition to turning tumbler wheels to a set series of numbers is also known. One main design problem presents itself with locks of this type is that it requires one hand to hold the housing and the other hand to insert a key into keyhole and then turn a mechanism for opening. This is not convenient. Thus, continuing improvements in the exploitation of combination lock of this type are constantly being sought.

SUMMARY OF THE INVENTION

It is therefore an object of the present invention to provide a combination lock capable of being opened or closed by a single hand. The combination lock comprises a housing comprising a cover, a leg, and a resilient member; a shackle pivotably connected to the housing and comprising a terminating end mated with an open end of the leg, an inner intermediate projection, and a spring-loaded member at the other end; a tumbler wheel assembly comprising a plurality of tumbler wheels rotatably fastened within the housing, each tumbler wheel including a locking member having a notch, and a moveable member including a plurality of first openings for receiving the locking members, a plurality of protrusions each formed at an inner wall of the first opening, an inward projecting member including a bore and two opposite inclined grooves on an inner wall of the bore, the projecting member being urged by the resilient member; a mechanism comprising a cylinder, a keyhole in the cylinder, a shaft projected inward, the shaft having a lengthwise flat on its surface, and a cam at a joining portion of the shaft and the cylinder; and a spring-loaded shuttle assembly biased against the projecting member and comprising a cylinder, a head, a channel in the cylinder, the channel having a lengthwise flat on its inner wall, two opposite tabs on an outer surface of the cylinder proximate an end of the channel, a spring-loaded L-shaped member having a second opening engaged with both the cam and the spring-loaded member. The shaft is inserted through the second opening and the bore into the channel, a distance between one end of the shaft and a blind end of the channel is formed, and the head is engaged with the projection in an unlocked position of the lock. In a first lock opening operation a key is inserted into the keyhole and the key is turned to rotate the shaft, the cam, and the cylinder of the shuttle assembly for aligning the tabs with the grooves, causing the cam to contact and push the second opening laterally, causing the L-shaped member to compress the spring-loaded member for opening a gap between the leg and the shackle with the distance between one end of the shaft and the blind end of the channel being decreased to a minimum as the channel slides relative to the shaft, and moving the tabs along the grooves to project the cylinder of the shuttle assembly from one end of the bore to the other end thereof by compressing the resilient member.

In one aspect of the present invention in a second lock opening operation the tumbler wheels are turned to a set series of numbers for aligning the notches of the locking members with the protrusions such that pivotably pushing the shackle inward will cause the projection to press the head, move the projecting member to compress the resilient member, engage the notches of the locking members with the protrusions, and create a gap between the leg and the shackle.

The above and other objects, features and advantages of the present invention will become apparent from the following detailed description taken with the accompanying drawings.

DETAILED DESCRIPTION OF THE INVENTION

Figure 1:
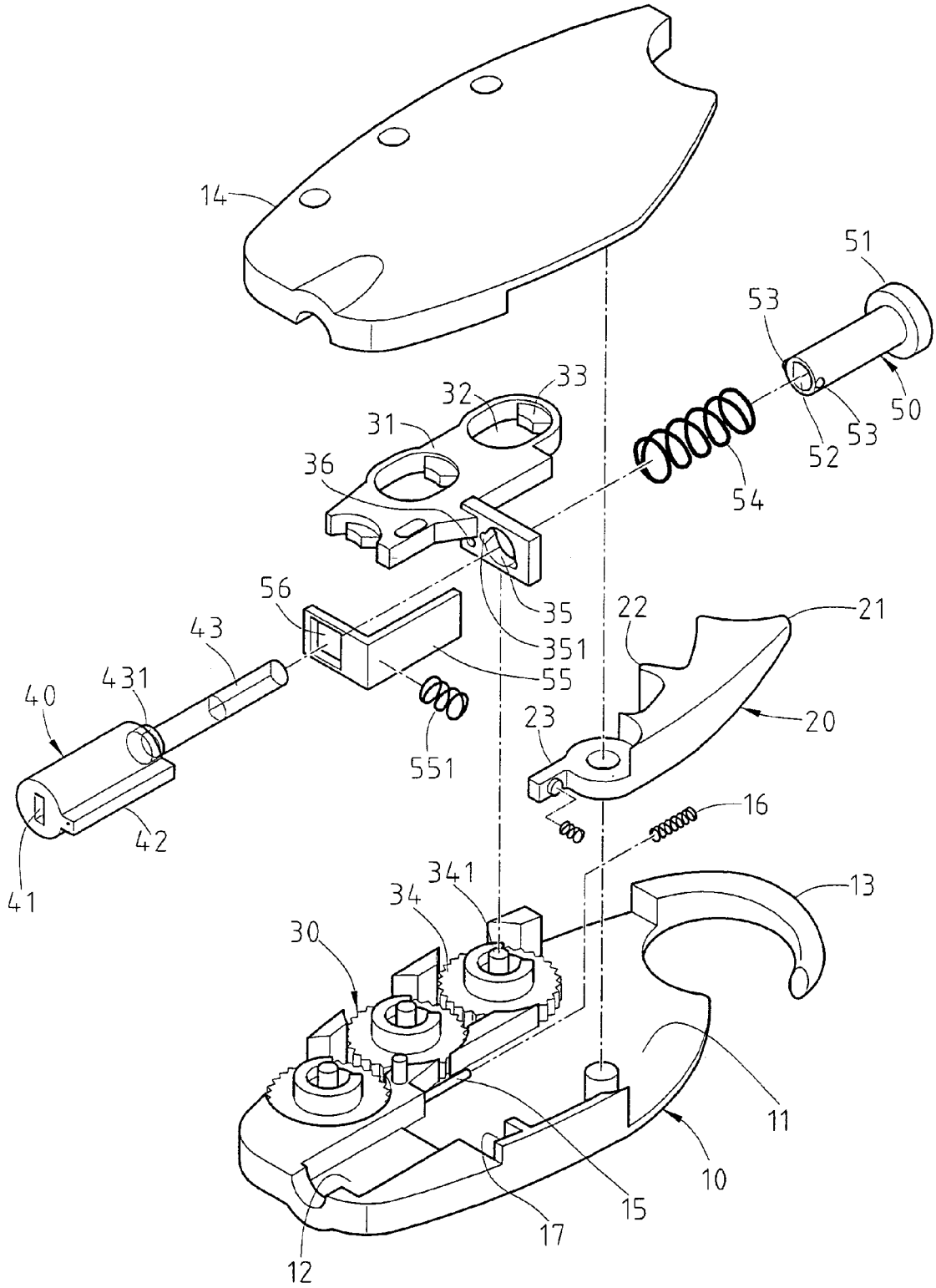
FIG. 1 is an exploded view of a preferred embodiment of combination lock according to the invention.
Figure 2:
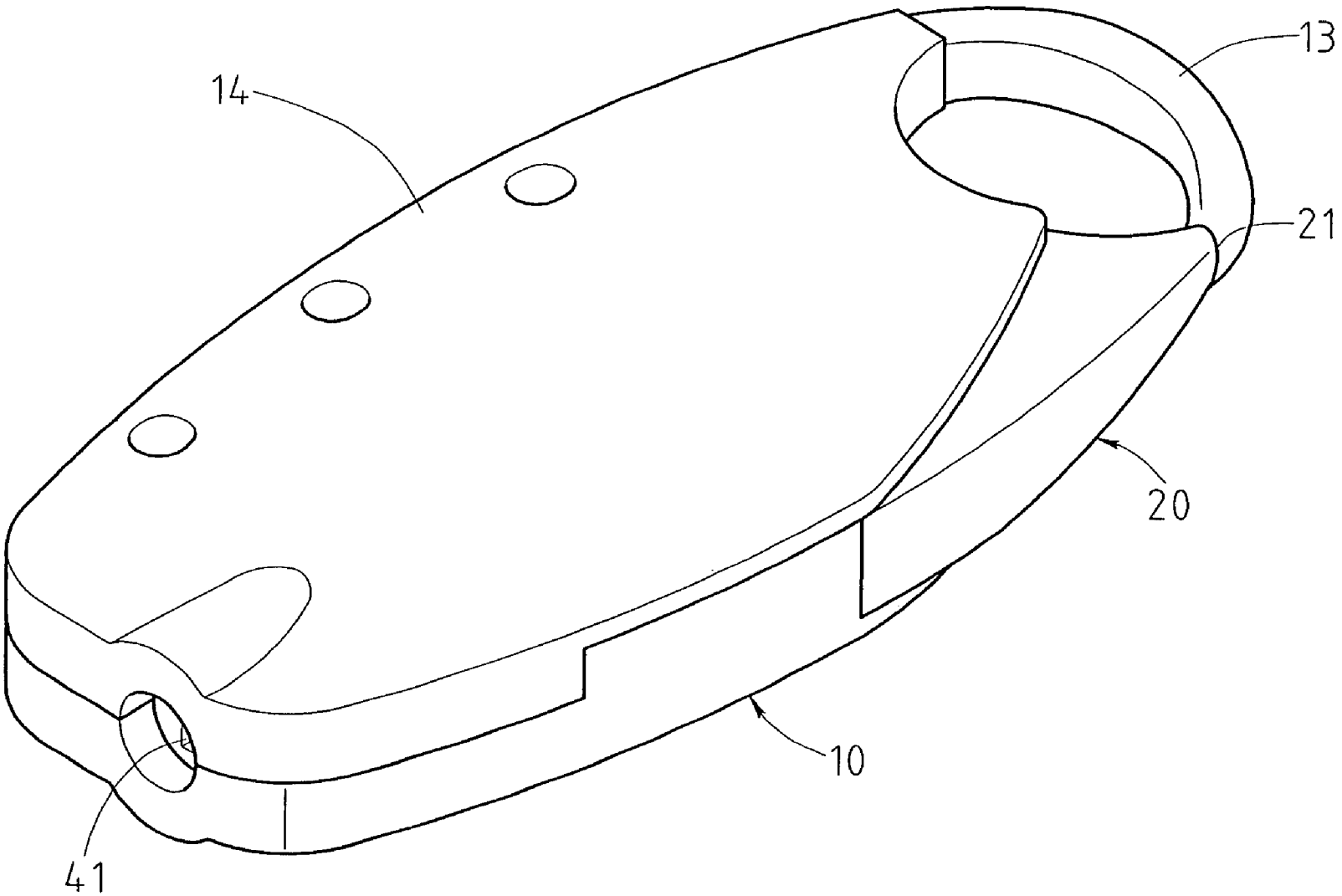
FIG. 2 is a perspective view of the assembled combination lock.
Figure 3:
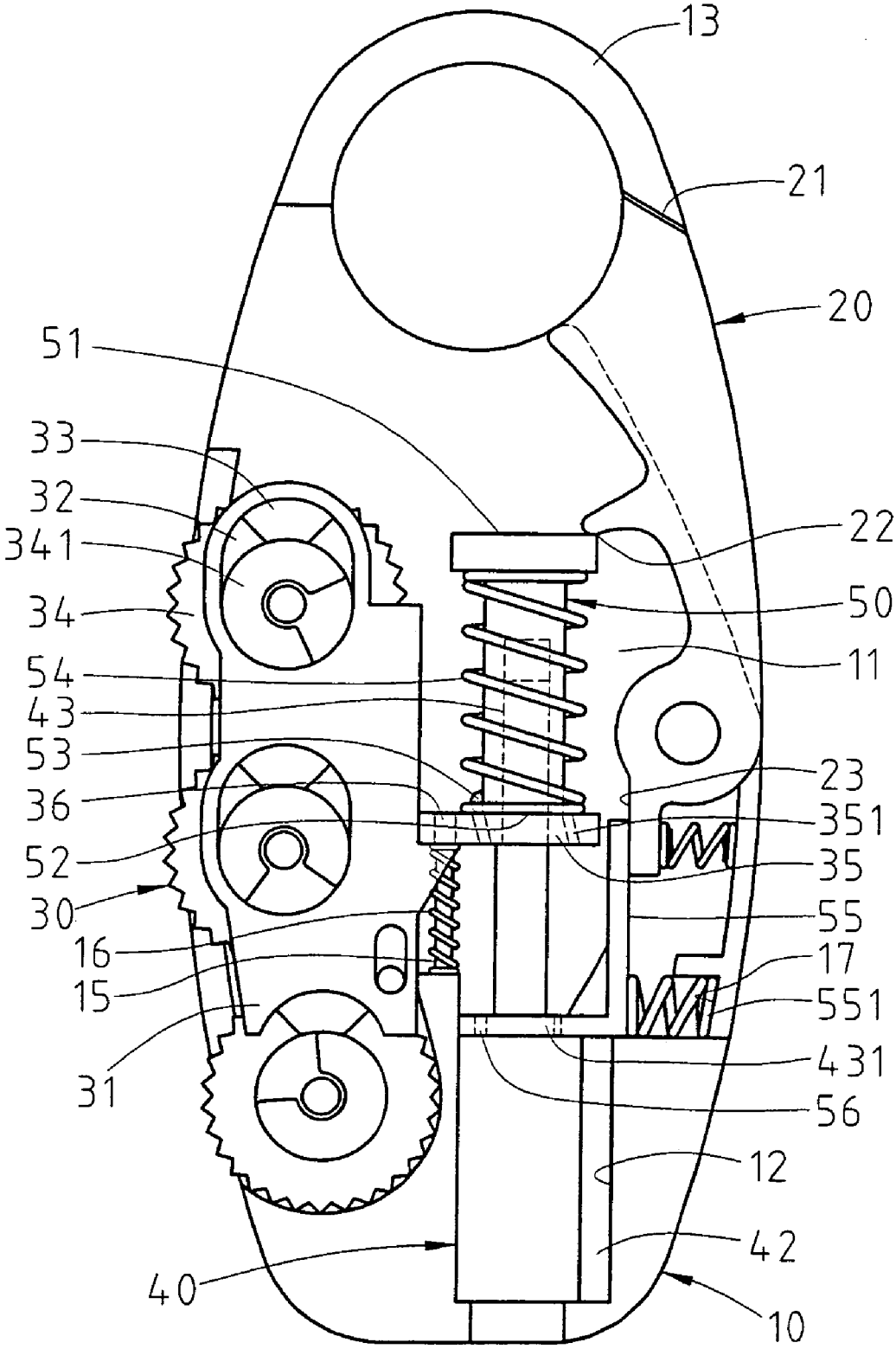
FIG. 3 is a top view of FIG. 2 with the covered being removed.

Referring to FIGS. 1, 2 and 3, there is shown a combination lock constructed in accordance with a preferred embodiment of the invention. The combination lock comprises a housing 10, a shackle 20, a tumbler wheel assembly 30, a mechanism 40, and a shuttle assembly 50. Each component is discussed in detailed below.

The housing 10 comprises a cover 14 and a mated base including a first recess 11, a second recess 12 communicated with the first recess 11, a curved leg 13, a rod 15, a first spring 16 put on the rod 15, and a well 17 on an inner wall. The shackle 20 is received in the first recess 11 and comprises a terminating end 21 mated with open end of the leg 13, an inner intermediate projection 22, and a spring-loaded member 23 at the other end. The shackle 20 is adapted to pivot about the housing 10.

The tumbler wheel assembly 30 comprises three tumbler wheels 34 rotatably secured onto the base of the housing 10, each tumbler wheel 34 having a dial with distinct indicia on its outer surface, and a locking member 341 having a notch, the locking member 341 co-rotated with the tumbler wheel 34, and a moveable member 31 including two elliptical openings 32 for receiving the locking members 341, three wedge-shaped protrusions 33 in which each of two of them is formed at an inner wall of the opening 32, a projecting member having a bore 35, two opposite inclined grooves 351 on an inner wall of the bore 35, and a hole 36 having a blind end with an end of the rod 15 disposed therein and the first spring 16 being compressed. The cylindrical mechanism 40 is received in the second recess 12 and comprises a keyhole 41, a lengthwise ridge 42 on its outer surface, a shaft 43 projected inward, the shaft 43 having a lengthwise flat on its surface, and a cam 431 at a joining portion of the shaft 43 and the main body of the mechanism 40.

The pin shaped shuttle assembly 50 comprises an enlarged head 51 engaged with the projection 22, a channel 52 in the cylindrical portion of the pin, the channel 52 having a lengthwise flat on its inner wall, two opposite tabs 53 on an outer surface of the pin proximate an open end of the channel 52, a second spring 54 put on the cylindrical portion and compressed between the head 51 and the projecting member having the bore 35, an L-shaped member 55 having a square opening 56 engaged with the joining portion of the shaft 43 and the main body of the mechanism 40 in which an upper portion of the L-shaped member 55 contacts the spring-loaded member 23 (see FIG. 3), and a third spring 551 compressed between the well 17 and a bent portion of the opening L-shaped member 55. The shaft 43 inserts through the opening 56 and the bore 35 into the channel 52 for matingly engaging therewith. At a locked state of the lock, there is a distance between the end of the shaft 43 and the blind end of the channel 52.

Figure 4:
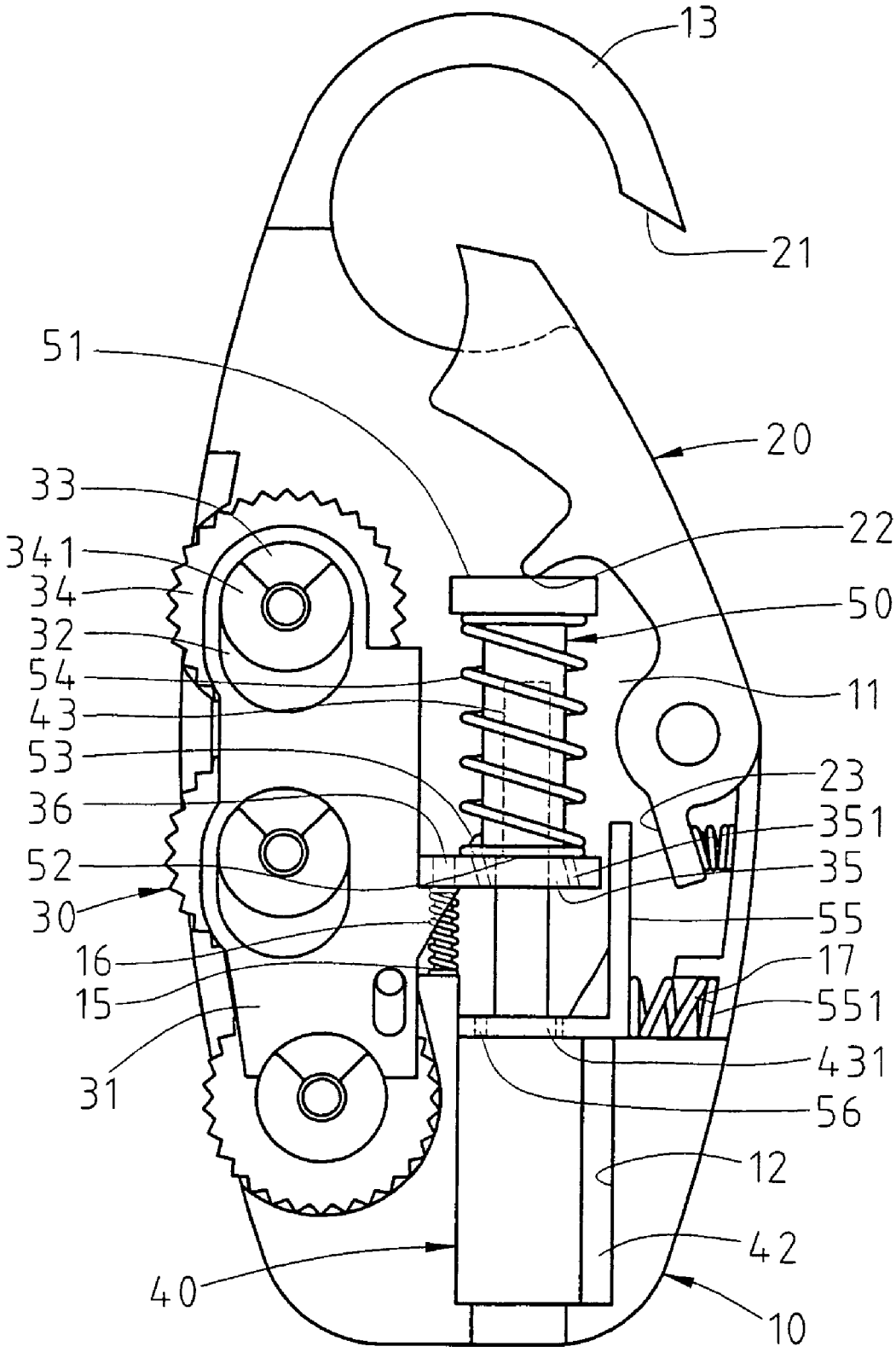
FIG. 4 is a view similar to FIG. 3, where the lock is opened after turning tumbler wheels to a set series of numbers.

Referring to FIG. 4, in one lock opening operation a user may turn the dial of the tumbler wheels 34 to a set series of numbers. At this position, the notches of the locking members 341 are matingly aligned with the protrusions 33. Next, the user may pivotably push the shackle 20 inward to cause the projection 22 to press the head 51. Accordingly, the projecting member having the bore 35 (i.e., the moveable member 31) moves to compress the first spring 16. The compression of the first spring 16 is made possible due to, as stated above, the alignment of the notches of the locking members 341 with the protrusions 33. That is, the compression of the first spring 16 will continue until the notches of the locking members 341 are completely engaged with the protrusions 33. This will create a sufficient gap between the terminating end 21 and the end of the shackle 20 for opening the lock. It is understood that releasing the shackle 20 will cause the shackle 20 to contact the terminating end 21 and move the tumbler wheel assembly 30 as shown in FIG. 3 due to the expansion of the first spring 16. Finally, the user may turn the dial of the tumbler wheels 34 to an incorrect series of numbers for locking the lock again. At this position, the notches of the locking members 341 are not matingly aligned with the protrusions 33.

Figure 5:
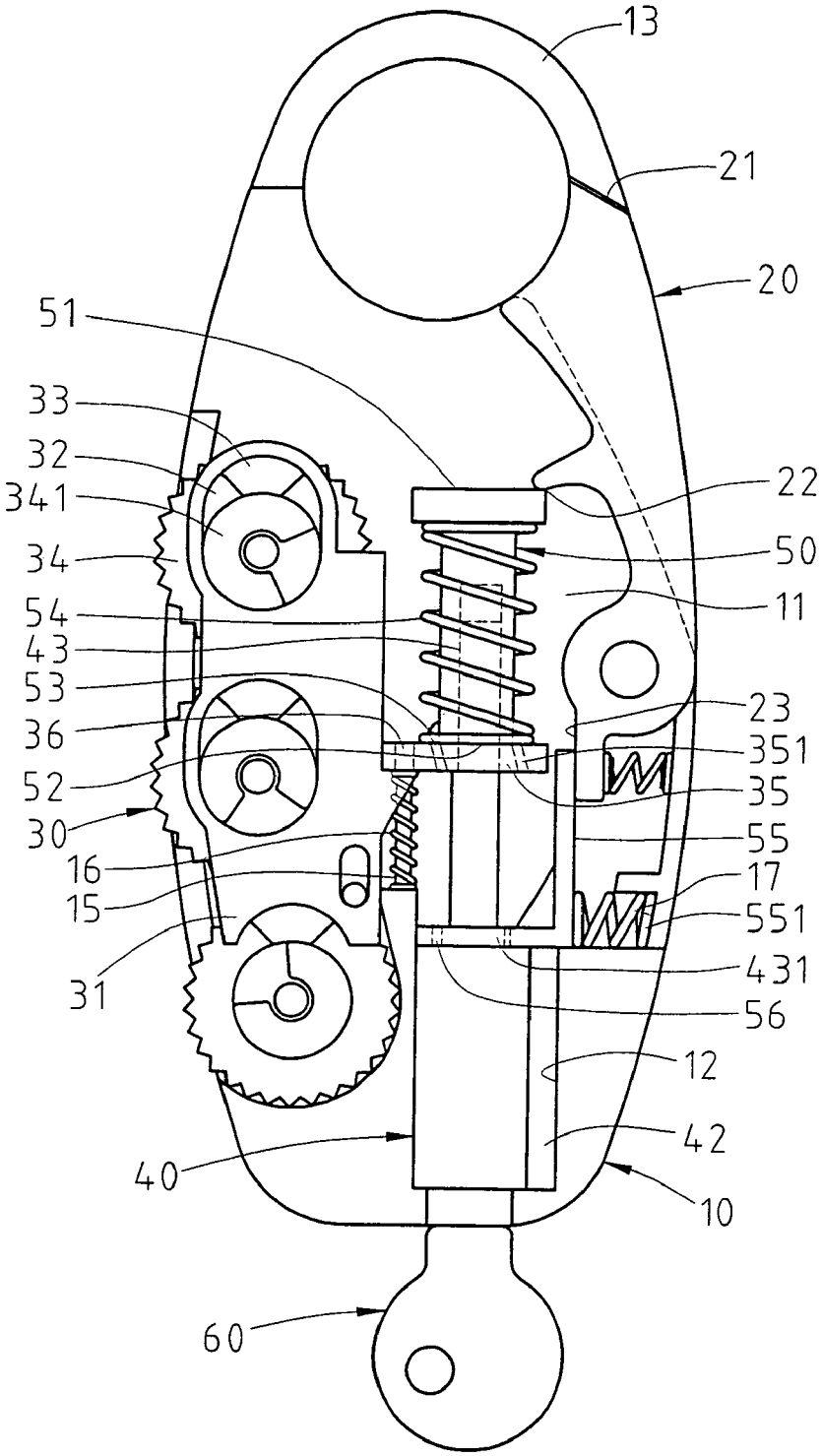
FIG. 5 is a view similar to FIG. 3, where a key is inserted into keyhole for opening the combination lock.
Figure 6:
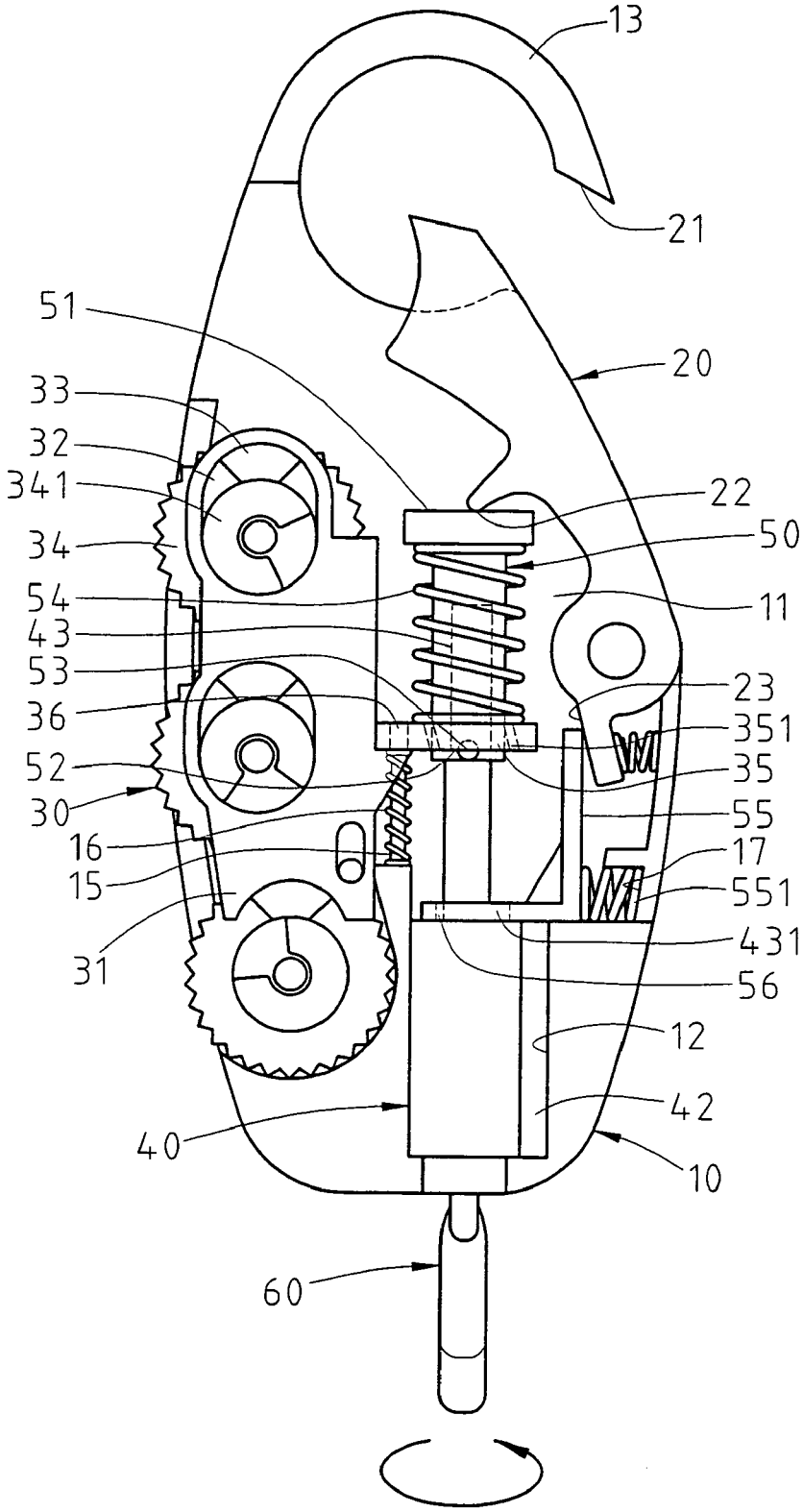
FIG. 6 is a view similar to FIG. 5, where the lock is opened by turning the key.
Figure 7:
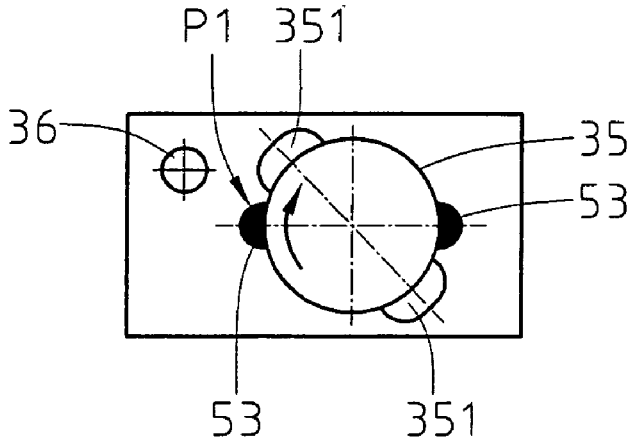
FIGS. 7 and 8 are plan views depicting relative position of the bore and the tab as indicated by P1 in a case of the lock unlocked and relative position of the bore and the tab as indicated by P2 in a case of the lock opened in response to turning the shuttle assembly by turning the key in the mechanism respectively.
Figure 8:
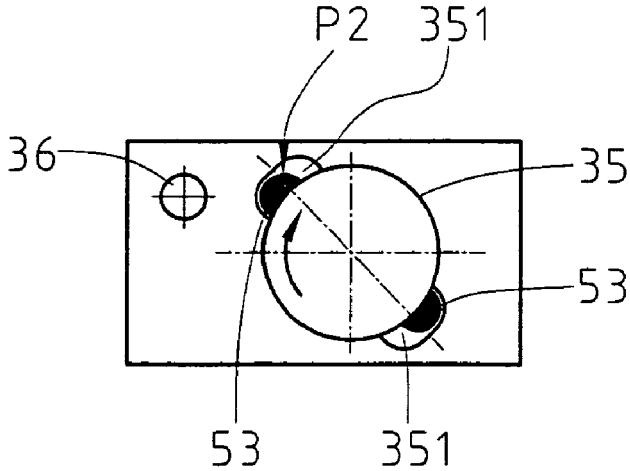
Figure 9:
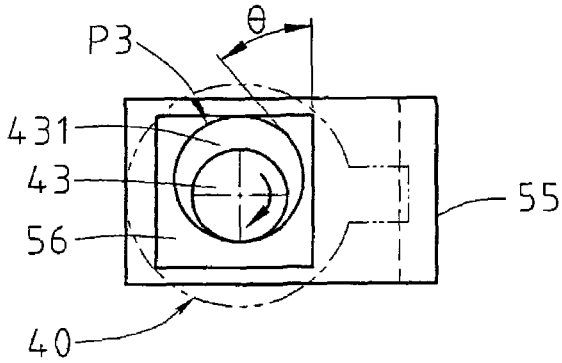
FIGS. 9, 10, and 11 are plan views depicting relative positions of the opening and the cam as indicated by P3, P4, and P5 respectively during the process of opening the lock by turning the key in the mechanism.
Figure 10:
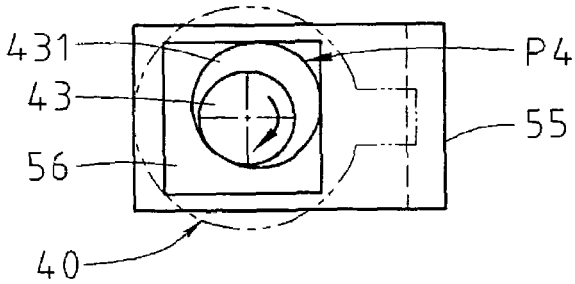
Figure 11:
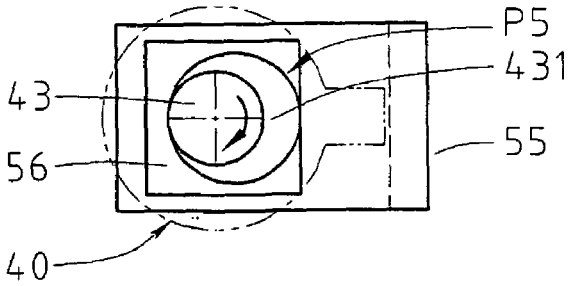

Referring to FIGS. 5 to 11, in another lock opening operation a user may insert a key 60 into the keyhole 41 prior to turning the key 60. Both the shaft 43 and the cam 431 rotate and thus the shuttle assembly 50 rotates accordingly. The tabs 53 thus rotate from the position indicated by arrow P1 (see FIG. 7) to the position indicated by arrow P2 (i.e., the tabs 53 are aligned with the inclined grooves 351 as shown in FIG. 8). At the same time, the cam 431 rotates an angle θ from the position indicated by arrow P3 (see FIG. 9) to the position indicated by arrow P4 (see FIG. 10). In FIG. 10, the cam 431 contacts the opening 56. A continuous rotation of the key 60 will cause the cam 431 to push the opening 56 laterally and thus the L-shaped member 55 to the right (see FIG. 11). In the position shown in FIG. 11, both the third spring 551 and the spring-loaded member 23 are compressed by the L-shaped member 55. As such, a sufficient gap between the terminating end 21 and the end of the shackle 20 is created (i.e., the lock is opened) in which the second spring 54 is compressed, the distance between the end of the shaft 43 and the blind end of the channel 52 is decreased to a minimum as the channel 52 slides relative to the shaft 43, and the tabs 53 move along the inclined grooves 351 to cause an end of the cylindrical portion of the shuttle assembly 50 to slightly project at the other end of the bore 35 and compress the first spring 16 (see FIG. 6). This is done by a single hand. It is understood that rotating the key 60 in a direction opposite to the above will cause all spring members to expand until the shackle 20 contacts the terminating end 21 again (i.e., the lock is locked) as shown in FIG. 5.

While the invention herein disclosed has been described by means of specific embodiments, numerous modifications and variations could be made thereto by those skilled in the art without departing from the scope and spirit of the invention set forth in the claims.

What is claimed is:

1. A combination lock, comprising:

a housing comprising a cover, a leg, and a resilient member;

a shackle pivotably connected to the housing and comprising a terminating end mated with an open end of the leg, an inner intermediate projection, and a spring-loaded member at the other end;

a tumbler wheel assembly comprising a plurality of tumbler wheels rotatably fastened within the housing, each tumbler wheel including a locking member having a notch, and a moveable member including a plurality of first openings for receiving the locking members, a plurality of protrusions each formed at an inner wall of the first opening, an inward projecting member including a bore and two opposite inclined grooves on an inner wall of the bore, the projecting member being urged by the resilient member;

a mechanism comprising a cylinder, a keyhole in the cylinder, a shaft projected inward, the shaft having a lengthwise flat on its surface, and a cam at a joining portion of the shaft and the cylinder; and a spring-loaded shuttle assembly biased against the projecting member and comprising a cylinder, a head, a channel in the cylinder, the channel having a lengthwise flat on its inner wall, two opposite tabs on an outer surface of the cylinder proximate an end of the channel, a spring-loaded L-shaped member having a second opening engaged with both the cam and the spring-loaded member;

wherein:

the shaft is inserted through the second opening and the bore into the channel, a distance between one end of the shaft and a blind end of the channel is formed, and the head is engaged with the projection in an unlocked position of the lock; and in a first lock opening operation a key is inserted into the keyhole and the key is turned to rotate the shaft, the cam, and the cylinder of the shuttle assembly for aligning the tabs with the grooves, causing the cam to contact and push the second opening laterally, causing the L-shaped member to compress the spring-loaded member for opening a gap between the leg and the shackle with the distance between one end of the shaft and the blind end of the channel being decreased to a minimum as the channel slides relative to the shaft, and moving the tabs along the grooves to project the cylinder of the shuttle assembly from one end of the bore to the other end thereof by compressing the resilient member.

2. The combination lock of claim 1, wherein in a second lock opening operation the tumbler wheels are turned to a set series of numbers for aligning the notches of the locking members with the protrusions such that pivotably pushing the shackle inward will cause the projection to press the head, move the projecting member to compress the resilient member, engage the notches of the locking members with the protrusions, and create a gap between the leg and the shackle.

* * * * *